US010283891B2

(12) United States Patent
Maesoba et al.

(10) Patent No.: US 10,283,891 B2
(45) Date of Patent: May 7, 2019

(54) SHIELD TERMINAL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroyoshi Maesoba, Mie (JP); Kazuhiro Yoshida, Mie (JP); Toshifumi Ichio, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/896,523

(22) Filed: Feb. 14, 2018

(65) Prior Publication Data

US 2018/0261945 A1 Sep. 13, 2018

(30) Foreign Application Priority Data

Mar. 8, 2017 (JP) ..... 2017-043807

(51) Int. Cl.

| | |
|---|---|
| ***H01R 9/03*** | (2006.01) |
| ***H01R 13/436*** | (2006.01) |
| ***H01R 13/422*** | (2006.01) |
| ***H01R 9/05*** | (2006.01) |
| *H01R 13/642* | (2006.01) |
| *H01R 13/6581* | (2011.01) |

(52) U.S. Cl.

CPC ..... *H01R 13/436* (2013.01); *H01R 9/038* (2013.01); *H01R 9/0527* (2013.01); *H01R 13/422* (2013.01); *H01R 9/0518* (2013.01); *H01R 13/642* (2013.01); *H01R 13/6581* (2013.01)

(58) Field of Classification Search

CPC .. H01R 13/436; H01R 9/0527; H01R 13/422; H01R 9/038; H01R 9/0518; H01R 13/6581; H01R 13/642

USPC ..... 439/752, 595, 607.5, 607.48, 607.27

See application file for complete search history.

(56) References Cited

U.S. PATENT DOCUMENTS

| | | | | |
|---|---|---|---|---|
| 8,715,016 | B2 * | 5/2014 | DeBock | H01R 13/514 439/701 |
| 2011/0081803 | A1 * | 4/2011 | Kawaguchi | H01R 9/035 439/607.5 |
| 2018/0026401 | A1 * | 1/2018 | Kanda | H01R 4/184 439/607.5 |

FOREIGN PATENT DOCUMENTS

| | | |
|---|---|---|
| JP | 2012-129103 | 7/2012 |

* cited by examiner

*Primary Examiner* — Abdullah A Riyami
*Assistant Examiner* — Nelson R. Burgos-Guntin
(74) *Attorney, Agent, or Firm* — Gerald E. Hespos; Michael J. Porco; Matthew T. Hespos

(57) ABSTRACT

A shield terminal (12) includes a dielectric (22) made of synthetic resin and formed with conductor accommodation chambers (39) inside, inner conductors (15) accommodated in the conductor accommodation chambers (39), an outer conductor (14) for surrounding the dielectric (22), and wall portions (24, 35) constituting the conductor accommodation chambers (39) and formed with air chambers (42, 43, 45 and 46). Focusing on the fact that air has a lower dielectric constant than synthetic resin, the air chambers (42, 43, 45 and 46) are formed in the wall portions (24, 35) constituting the conductor accommodation chambers (39). This enables (Continued)

an impedance to be enhanced even if the dielectric (22) is made of a material having high rigidity.

15 Claims, 7 Drawing Sheets

SHIELD TERMINAL

BACKGROUND

Field of the Invention

The invention relates to a shield terminal.

Description of the Related Art

Japanese Unexamined Patent Publication No. 2012-129103 discloses a shield terminal with an inner conductor terminal accommodated in a dielectric and an outer conductor surrounding the dielectric. Impedance matching enhances the reliability of communication performance when a shield terminal of this type is used in a high-speed communication circuit.

If an impedance of a shield terminal is low, it is thought to use a material having a low dielectric constant, e.g. polypropylene as a material of the dielectric to enhance the impedance. However, polypropylene has low mechanical rigidity and is undesirable as a material for holding the inner conductor terminal.

The invention was completed on the basis of the above situation and aims to enhance an impedance without reducing the rigidity of a dielectric.

SUMMARY

The invention relates to a shield terminal with a dielectric made of synthetic resin and formed with at least one conductor accommodation chamber inside. An inner conductor is accommodated in the conductor accommodation chamber, and an outer conductor surrounding the dielectric. The conductor accommodation chamber has a wall formed with an air chamber.

A front part of the inner conductor is formed with a tubular body for receiving a mating conductor. The tubular body may define a substantially polygonal tube. The air chamber may be disposed in an area corresponding to the body in a front-rear direction.

The mating conductor is inserted in the body portion and an occupation ratio of metal is large in an area where the front part of the inner conductor is disposed. Thus, impedance may be lower than in other areas. However, the air chamber is disposed in the area corresponding to the body. Thus, an impedance in the area where the front part of the inner conductor is disposed can be enhanced substantially to the same extent as in the other areas.

At least one lock may be formed on the body, and at least one retaining portion may be formed on a base wall of the conductor accommodation chamber. The retaining portion and the lock can engage for restricting a rearward relative displacement of the inner conductor.

The air chamber may be disposed only in an area of the bottom wall before the retaining portion. According to this configuration, the air chamber can be disposed in the area corresponding to the body while the retaining portion for retaining the inner conductor is formed on the bottom wall.

The retaining portion may be formed on a rear part of the air chamber. According to this configuration, the air chamber can be ensured to be large without complicating the shape of the wall.

The dielectric may be configured by uniting a first component including a front wall and a second component for holding the inner conductor to sandwich the inner conductor between the first component and the second component. The mating conductor may be insertable into an insertion opening of the front wall.

The first component is made of a material having higher mechanical strength than the second component, and/or the second component is made of a material having a lower dielectric constant than the first component. The material of the first component may be polybutylene terephthalate (PBT) and/or the material of the second component may be polypropylene (PP), polyethylene (PE), polystyrene (PS) or foamed polybutylene terephthalate.

According to this configuration, even if the mating conductor interferes with the wall, there is no possibility that the mating conductor is pierced into the front wall. Further, since the second component is made of the material having a low dielectric, the impedance can be enhanced.

The shield connector may be a connecting member forming part of a wiring harness for Ethernet.

Air has a lower dielectric constant than synthetic resin. The air chamber is formed in the wall constituting the conductor accommodation chamber. This enables an impedance to be enhanced even if the dielectric is made of a material having high rigidity.

These and other objects, features and advantages of the present invention will become more apparent upon reading of the following detailed description of and accompanying drawings. It should be understood that even though embodiments are described separately, single features thereof may be combined to additional embodiments.

DETAILED DESCRIPTION

Figure 1:
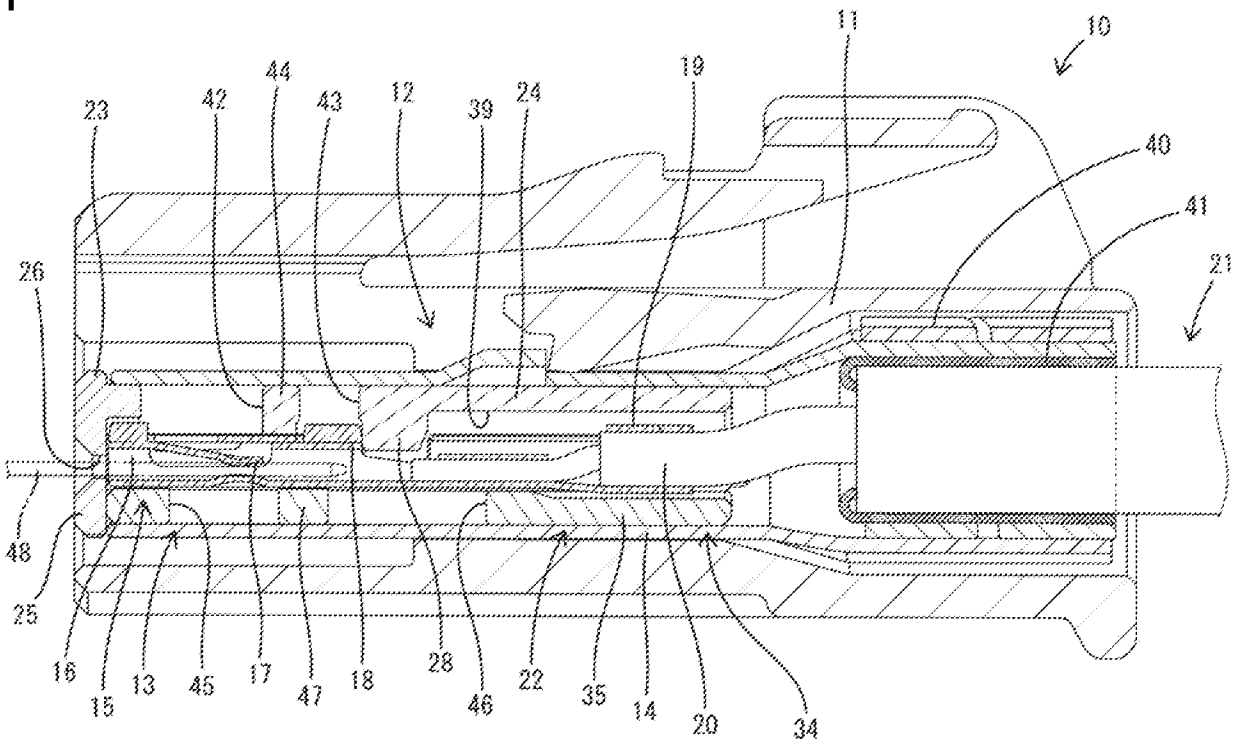
FIG. 1 is a section showing a state where a shield terminal of one embodiment is mounted in a housing.
Figure 2:
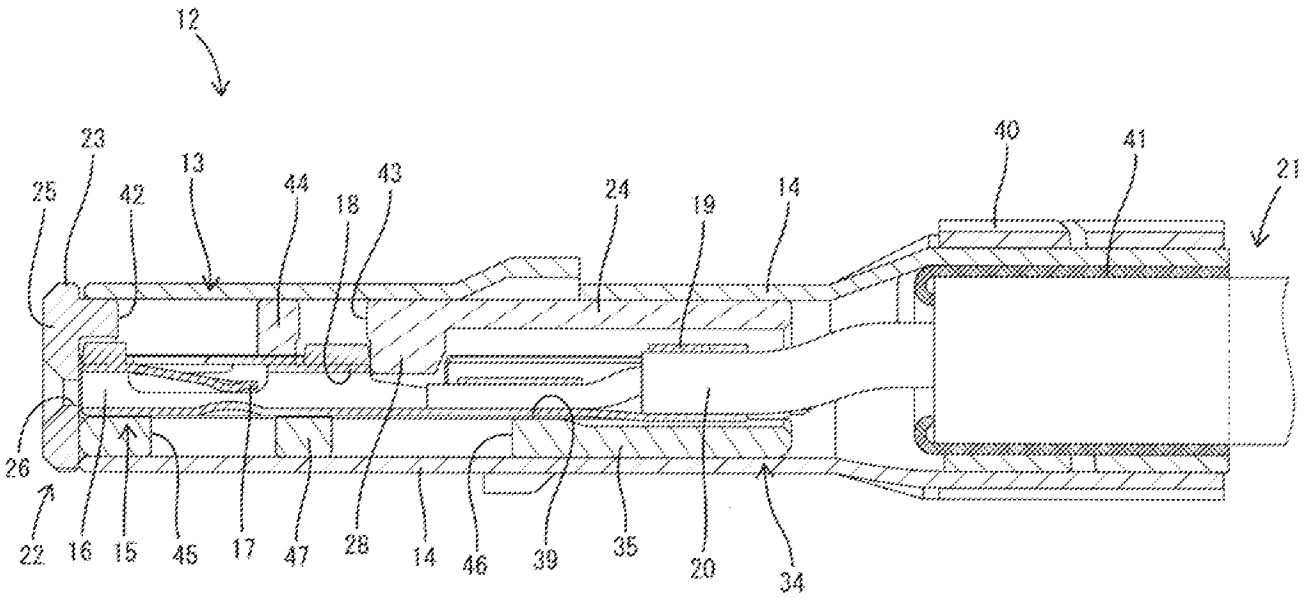
FIG. 2 is a section of the shield terminal.
Figure 3:
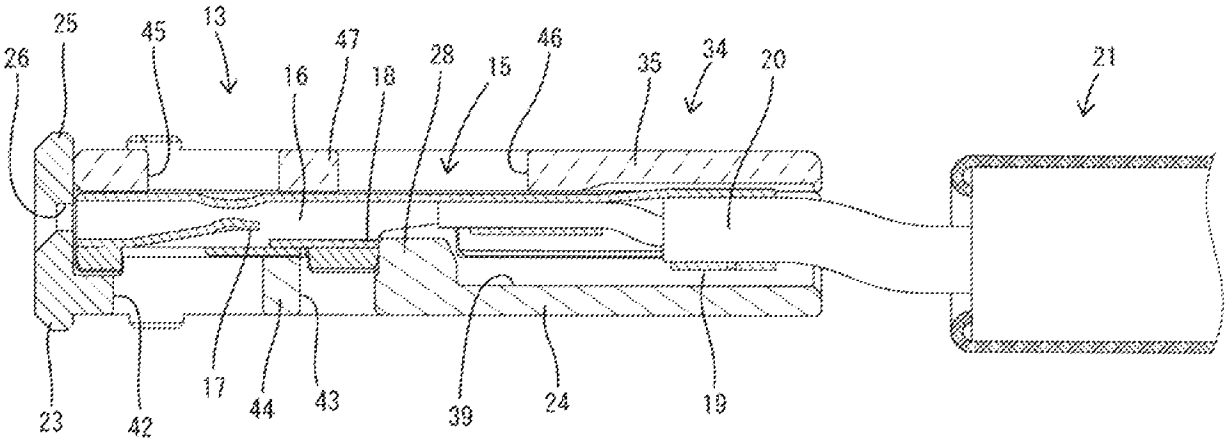
FIG. 3 is a section of a terminal unit.
Figure 4:
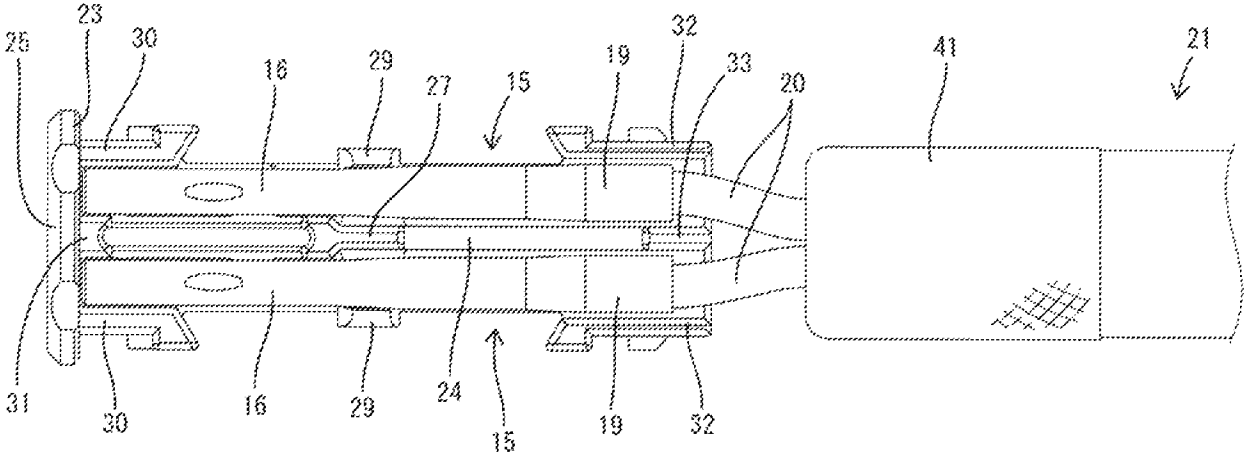
FIG. 4 is a plan view showing a state where inner conductors are mounted in a first component.
Figure 5:
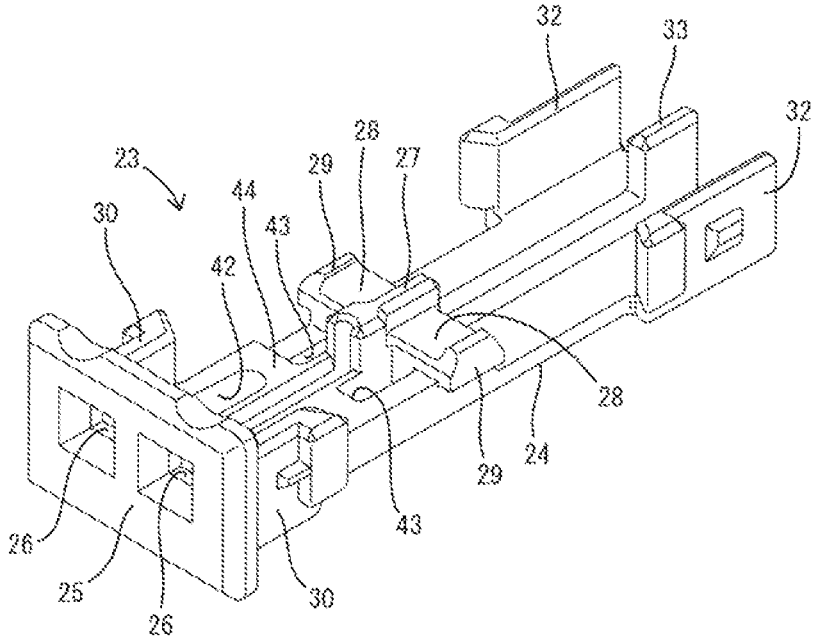
FIG. 5 is a perspective view of the first component.
Figure 6:
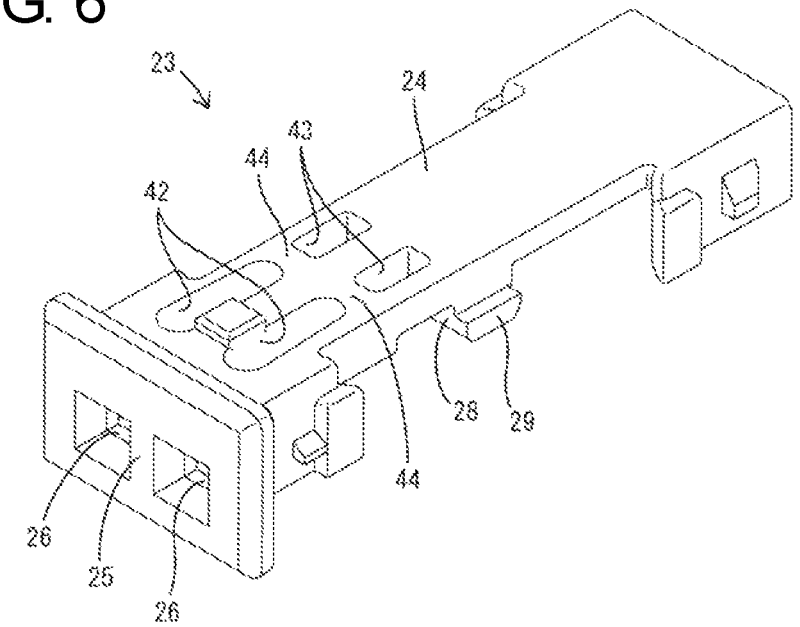
FIG. 6 is a perspective view showing a vertically inverted state of the first component.
Figure 7:
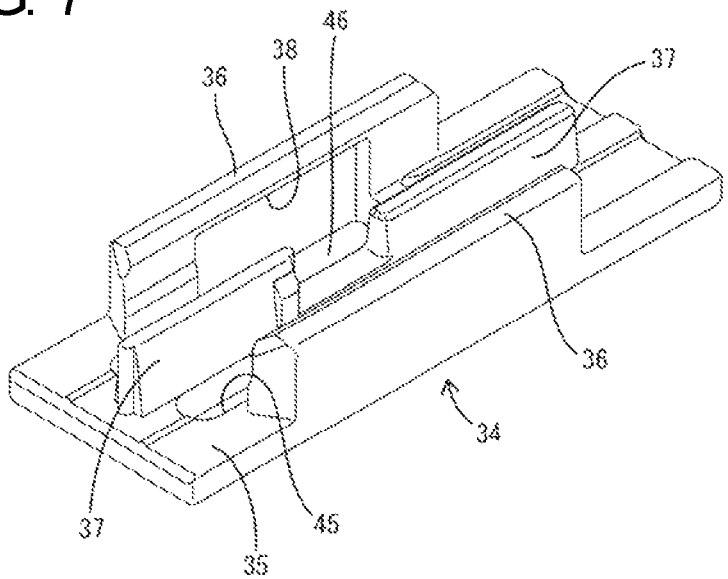
FIG. 7 is a perspective view showing a vertically inverted state of a second component.
Figure 8:
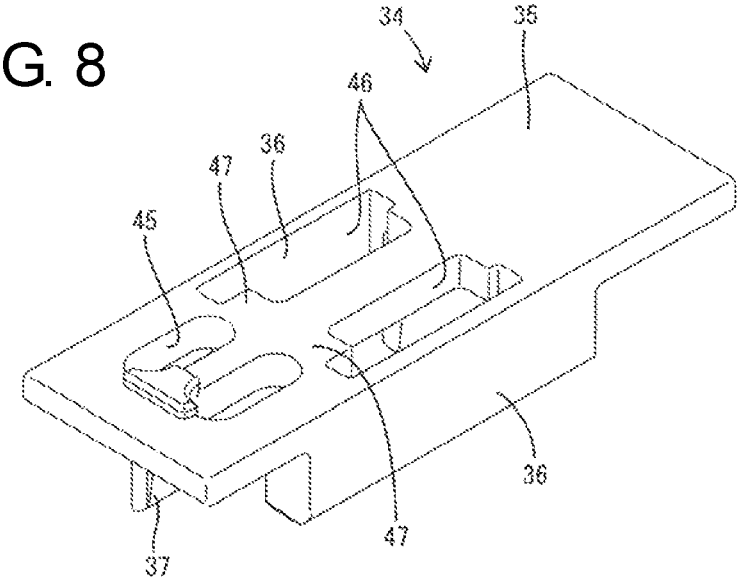
FIG. 8 is a perspective view showing the second component.
Figure 9:
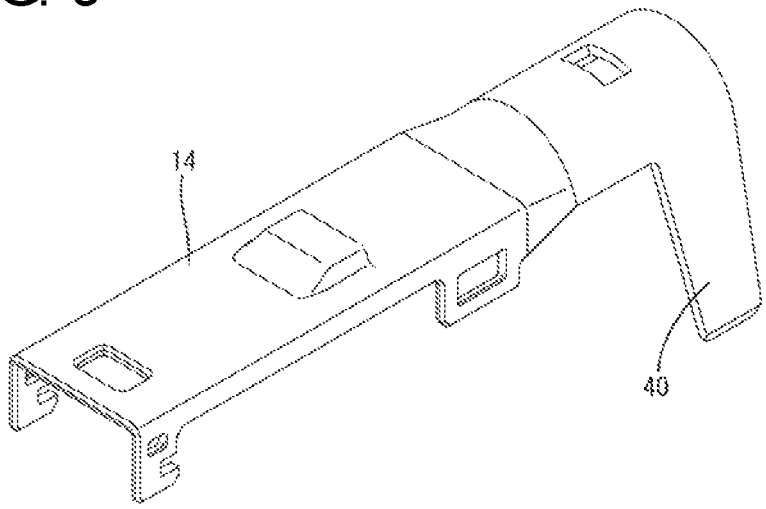
FIG. 9 is a perspective view of an outer conductor.
Figure 10:
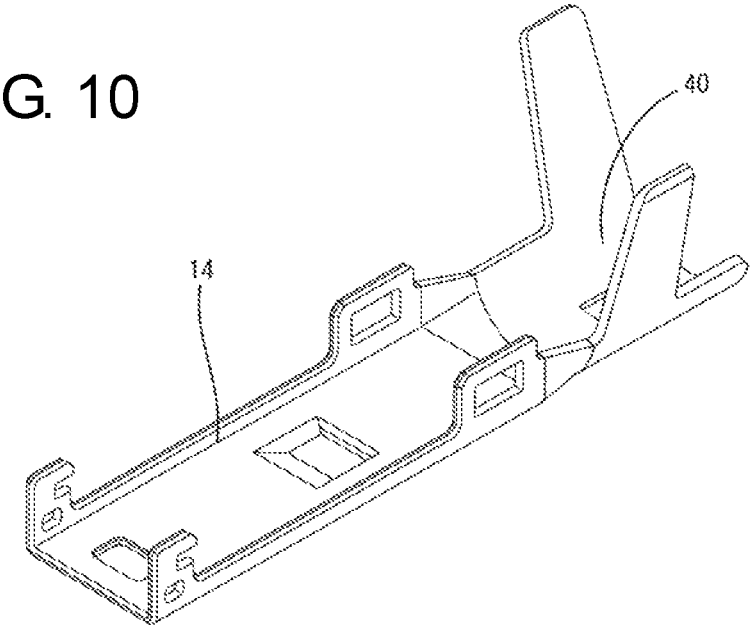
FIG. 10 is a perspective view showing an inverted state of the outer conductor.

Hereinafter, one specific embodiment of the present invention is described with reference to FIGS. 1 to 10. Note that, in the following description, a left side in FIGS. 1 to 10 is defined as a front concerning a front-rear direction. Upper and lower sides shown in FIGS. 3, 5 and 8 are defined as upper and lower sides concerning a vertical direction.

A shield connector 10 of this embodiment is a connecting member constituting or forming part of a wiring harness for Ethernet® high-speed communication circuit e.g. of an automotive vehicle and includes a housing 11 made of synthetic resin and a shield terminal 12 accommodated in the housing 11. The shield terminal 12 is configured by assembling a terminal unit 13 and an outer conductor 14. One terminal unit 13 is configured by accommodating two inner conductors 15 into a dielectric 22.

The inner conductor 15 is long and narrow in the front-rear direction. A rectangular tubular body 16 is formed in a front end part of the inner conductor 15. A mating conductor 48 in the form of a long narrow tab is inserted into the body 16 of the inner conductor 15 from the front. The mating conductor 48 inserted into the body 16 resiliently contacts a resilient contact piece 17 formed in the body 16 so that the mating conductor 48 and the inner conductor 15 are connected electrically conductively. A step-like locking portion 18 is formed on a rear end part of the body 16. A crimping portion 19 in the form of an open barrel is formed in a rear part of the inner conductor 15, and a front part of a wire 20 is fixed electrically conductively to the crimping portion 19. Two wires 20 connected to two inner conductors 15 constitute a twisted pair cable 21.

The dielectric 22 is configured by uniting a first component 23 in the form of a halved piece made of synthetic resin and a second component 34 in the form of a halved piece made of synthetic resin in the vertical or lateral direction (direction intersecting axes of the front end parts of the wires 20). A material of the first component 23 may be polybutylene terephthalate (PBT) and has a higher mechanical strength than the second component 34. A material of the second component 34 may be polypropylene (PP) and has a lower dielectric constant than the first component 23.

The first component 23 includes a bottom or base wall 24 that is long and narrow in the front-rear direction and a front wall 25 rises from the front end of the bottom wall 24. Left and right insertion openings 26 penetrate through the front wall 25 for receiving the mating conductors 48. The first component 23 is formed with a central partition wall 27 rising from a lateral center position in a central part of the bottom wall 24 in the front-rear direction and two lateral retaining portions 28 are formed by causing areas of the central part of the bottom wall 24 in the front-rear direction connected to both left and right side surfaces of the central partition wall 27 to project up or in. Further, left and right lock projections 29 are formed on outer side surfaces of the left and right retaining portions 28.

The first component 23 is formed with left and right front side walls 30 rising from front end parts of both lateral (left and right) sides of the bottom wall 24 and a front partition 31 rising from a lateral center position on the front end part of the bottom wall 24. The front side walls 30 and the front partition 31 are connected to the rear surface of the front wall 25. The first component 23 is formed with lateral (left and right) rear side walls 32 rising from rear end parts of both lateral (left and right) sides of the bottom wall 24 and a rear partitioning portion 33 rising from a lateral center position on a rear part of the bottom wall 24.

The second component 34 includes an upper wall 35 that is long and narrow in the front-rear direction. Left and right side walls 36 extend down from both left and right sides of the upper wall 35 and front and rear separation walls 37 extending down from a lateral center position of the upper wall 35. Step-like locks 38 (see FIG. 7) are formed on inner surfaces of the side walls 36.

In assembling the first and second components 23, 34, the two inner conductors 15 are placed on the base wall 24 of the first component 23. The first and second components 23, 34 are divided in a direction substantially perpendicular to the front end parts of the wires 20 and are united. Thus, a moving direction when the inner conductors 15 are placed is also a direction substantially perpendicular to the axes of the front end parts of the wires 20. This enables the wires 20 to be untwisted over a minimum possible length in the front parts of the two wires 20 of the twisted pair cable 21. Thus, a reduction of a noise reducing function caused by untwisting the wires 20 is avoided.

The two inner conductors 15 placed in the first component 23 have displacements in the front-rear direction with respect to the first component 23 restricted by individually locking the locking portions 18 of the bodies 16 to the retaining portions 28. Further, the two inner conductors 15 are prevented from being displaced and inclined in the lateral direction by sandwiching the front end parts of the bodies 16 between the front side walls 30 and the front partition 31. Furthermore, the two inner conductors 15 are prevented from being displaced and inclined in the lateral direction by having rear parts of the crimping portions 19 sandwiched between the rear side walls 32 and the rear partition wall 33.

After the two inner conductors 15 are mounted in the first component 23, the second component 34 is assembled to be united with the first component 23. An assembling direction of the second component 34 with the first component 23 is substantially perpendicular to the axes of the front end parts of the wires 20. The dielectric 22 is configured when the first and second components 23 and 34 are united, and the two inner conductors 15 are assembled in a state accommodated in the dielectric 22 to complete assembly of the terminal unit 13.

The first and second components 23, 34 are united by locking the lock portions 38 and the lock projections 29. In the united state, the front walls 30, the side walls 36 and the rear walls 32 are disposed one after another and the front partition 31, the front separation walls 37, the central partition wall 27, the rear separation walls 37 and the rear partition wall 33 are disposed one after another. In this way, left and right conductor accommodation chambers 39 for individually accommodating the two inner conductors 15 are configured in the dielectric 22.

The terminal unit 13 is surrounded by the outer conductor 14 made of a conductive material (such as metal)I and is in the form of a rectangular tube. The outer conductor 14 is configured by vertically uniting an upper shell (first shell) and a lower shell (second shell). The shield terminal 12 is configured by surrounding the terminal unit 13 by the outer conductor 14. A barrel 40 formed in a rear end part of the outer conductor 14 is fixed to be able to contact a braided wire 41 of the twisted pair cable 21. The shield terminal 12 fixed to the twisted pair cable 21 is assembled by being inserted into the housing 11 from behind.

Since the shield connector 10 and the shield terminal 12 of this embodiment are used for a high-speed communication circuit, impedance matching is preferable to enhance the reliability of communication performance. If an impedance of the shield terminal 12 is low, the second component 34 of the dielectric 22 is made of a material (such as polypropylene) having a low dielectric constant for enhancing the impedance. However, since polypropylene has low mechanical rigidity, it is not desirable as a material having a function of stably holding the inner conductors 15.

Accordingly, the first component 23 is made of a material (such as polybutylene terephthalate) having high mechanical strength (e.g. a higher mechanical strength than the second component 34) to enhance the reliability of the function of holding the inner conductors 15. However, since polybutylene terephthalate has a high dielectric constant, it causes an impedance reduction. Thus, to enhance the impedance without reducing the rigidity of the dielectric 22, air chambers 42, 43, 45 and 46 are formed in the bottom wall 24 and the upper wall 35 of the conductor accommodation chambers 39 of the dielectric 22.

Specifically, two lateral (left and right) front first air chambers 42 are formed in a front part of the bottom wall 24 and left and right rear first air chambers 43 are formed at positions behind and near the front first air chambers 42 in the bottom wall 24. All of the first air chambers 42, 43 communicate with the insides of the conductor accommodation chambers 39 and the outside (bottom surface) of the dielectric 22. In other words, the first air chambers 42, 43 laterally extend from the conductor accommodation chambers 39 to an outer side of the dielectric 22. An area of the bottom wall 24 between the front first air chambers 42 and the rear first air chambers 43 functions as a reinforcing portion 44.

Further, the body 16 of the inner conductor 15 has a rectangular tubular shape. Thus, the amount of conductive material (e.g. metal) is more than the barrel of crimping portion 19. In addition, the mating conductor 48, which is a metal component, is inserted into the body 16 and the metal resilient locking portion 18 to be resiliently held in contact with the mating conductor 48 is present in the body 16. A formation area of the body 16 has high metal density. Thus, the impedance is lower than in an area behind the body 16. Accordingly, the rear end of the rear first air chamber 43 and the front end of the retaining portion 28 for locking the locking portion 18 are positioned adjacent to each other in the front-rear direction. Specifically, the front first air chamber 42 and the rear first air chamber 43 are disposed at a position corresponding to the body 16 of the inner conductor 15 in the front-rear direction.

Further, front second air chambers 45 are formed in a front end part of the upper wall 35 of the second component 34, and left and right rear second air chambers 46 are formed at positions behind and near the front second air chambers 45 in the upper wall 35. All of these second air chambers 45, 46 communicate with the insides of the conductor accommodation chambers 39 and the outside of the dielectric 22. In other words, the first air chambers 42, 43 laterally extend from the conductor accommodation chambers 39 to an outer side of the dielectric 22. A formation area of the front second air chambers 45 in the front-rear direction is substantially the same as that of the front first air chambers 42. A formation area of the rear second air chambers 46 in the front-rear direction is longer toward the rear side than that of the front first air chambers 42 and/or rear first air chambers 43. An area of the upper wall 35 between the front second air chambers 45 and the rear second air chambers 46 functions as a reinforcing portion 47.

The shield terminal 12 of this embodiment includes the dielectric 22 made of synthetic resin and formed with the left and right conductor accommodation chambers 39 inside, the left and right inner conductors 15 individually accommodated in the conductor accommodation chambers 39 and the outer conductor 14 surrounding the dielectric 22. The dielectric 22 is formed with the front first air chambers 42 and the rear first air chambers 43, and includes the bottom wall 24 constituting the conductor accommodation chambers 39. Similarly, the dielectric 22 is formed with the front second air chambers 45 and the rear second air chambers 46 and includes the upper wall 35 constituting the conductor accommodation chambers 39.

Polybutylene terephthalate, as the dielectric of the first component 23, has relatively high mechanical strength but a low dielectric constant. Thus, an impedance may be reduced. Accordingly, the air chambers 42, 43, 45 and 46 are formed in the bottom wall 24 and the upper wall 35 of the conductor accommodation chambers 39 of the dielectric 22. The air chambers 42, 43, 45 and 46 have a low dielectric constant (as compared to the material of the first component 23), so that the impedance is enhanced and the reliability of communication quality is enhanced.

Further, the body 16 is formed in the front end part of the inner conductor 15 and is a rectangular tube into which the mating conductor 48 is inserted electrically conductively. The mating conductor 48 is inserted in the body 16 in the area where the front part of the inner conductor 15 is disposed, and an occupancy ratio of metal is large. Thus, impedance may be lower than in other areas. Accordingly, the air chambers 42, 43, 45 and 46 are disposed in the areas corresponding to the body 16 in the front-rear direction. With this configuration, the impedance in the area where the front part of the inner conductor 15 is disposed can be enhanced substantially to the same extent as in the other areas.

The locking portions 18 are formed at the rear ends of the bodies 16. Further, the retaining portions 28 are formed on the bottom wall 24 in the conductor accommodation chambers 39 to restrict rearward displacements of the inner conductors 15 with respect to the first component 23 by having the locking portions 18 locked thereto. The front first air chambers 42 and the rear first air chambers 43 are disposed only in an area of the bottom wall 24 before the retaining portions 28. According to this configuration, the air chambers can be disposed in the area corresponding to the bodies 16 while the retaining portions 28 for retaining the inner conductors 15 are formed on the bottom wall 24. Further, since the retaining portions 28 are formed on rear parts of the rear first air chambers 43, the front first air chambers 42 and the rear first air chambers 43 can be large without complicating the shape of the bottom wall 24.

Further, the dielectric 22 is configured by uniting the first component 23 including the front wall 25 and the second component 34 to sandwich and hold the inner conductors 15 between the first and second components 23 and 34, and the mating conductors 48 are inserted into the insertion openings 26 of the front wall 25. The first component 23 may be made of polybutylene terephthalate, which is a material having higher mechanical strength than the second component 34, and the second component 34 may be made of polypropylene, which is a material having a lower dielectric constant than the first component 23. According to this configuration, since the material of the first component 23 has higher mechanical strength than the second component 34, even if the mating conductor 48 interferes with the front wall 25, there is no possibility that the mating conductor 48 will pierce the front wall 25. Further, since the second component 34 is made of a material having a low dielectric constant, the impedance can be enhanced.

The invention is not limited to the above described and illustrated embodiment. For example, the following embodiments also are included in the scope of the invention.

Although the air chambers are disposed in the area corresponding to the bodies of the inner conductors in the above embodiment, the air chambers may be disposed in an area not corresponding to the bodies.

Although the air chambers are formed only in the bottom wall and the upper wall of the dielectric in the above embodiment, the air chambers may be formed in the side walls (side surfaces of the dielectric).

Although the retaining portions are formed on the rear parts of the air chambers in the above embodiment, the retaining portions may be disposed at positions behind the rear ends of the air chambers.

Although the air chambers penetrate from the inner surface to the outer surface of the dielectric in the above embodiment, the air chambers may be formed by recessing the inner or outer surface of the dielectric without penetrating from the inner surface to the outer surface of the dielectric.

Although two inner conductors are accommodated in one dielectric in the above embodiment, one, three or more inner conductors may be accommodated into one dielectric.

Although the dielectric is composed of two components, i.e. the first component and the second component in the above embodiment, the dielectric may be composed of a single component.

Although two wires connected to the inner conductors constitute the twisted pair cable in the above embodiment, the invention can be applied when a wire to be connected to an inner conductor does not constitute a twisted pair cable.

Although the material of the first component is polybutylene terephthalate (PBT) in the above embodiment, the material of the first component may be other than polybutylene terephthalate.

Although the material of the second component is polypropylene (PP) in the above embodiment, the material of the second component may be polyethylene (PE), polystyrene (PS), foamed polybutylene terephthalate or the like.

Although a combination of the materials of the first component and the second component is a combination of polybutylene terephthalate and polypropylene in the above embodiment, the combination of the materials of the first component and the second component may be a combination of polybutylene terephthalate and polyethylene (PE) or a combination of polybutylene terephthalate and foamed polybutylene terephthalate.

REFERENCE SIGNS

12 . . . shield terminal
14 . . . outer conductor
15 . . . inner conductor
16 . . . body
18 . . . locking portion
22 . . . dielectric
23 . . . first component
24 . . . bottom wall
25 . . . front wall
26 . . . insertion opening
28 . . . retaining portion
34 . . . second component
35 . . . upper wall
39 . . . conductor accommodation chamber
42 . . . front first air chamber
43 . . . rear first air chamber
45 . . . front second air chamber
46 . . . rear second air chamber
48 . . . mating conductor

What is claimed is:

1. A shield terminal, comprising:

a dielectric having a first component made of polybutylene terephthalate (PBT) and a second component made of synthetic resin, at least one conductor accommodation chamber inside the dielectric and extending in a front-rear direction from a rear end substantially to a front end, at least one retaining portion formed on the first component and projecting into the conductor accommodation chamber at a position spaced from the front end;

at least one inner conductor at least partly accommodated in the conductor accommodation chamber, the at least one inner conductor having a substantially tubular body at a front part of the inner conductor, the at least one retaining portion engaging a rear end of the tubular body;

at least one outer conductor at least partly surrounding the dielectric; and at least one air chamber extending through a wall of the first component transverse to the front-rear direction and into the conductor accommodation chamber at a position forward of the retaining portion.

2. The shield terminal of claim 1, wherein the substantially tubular body is of the inner conductor is disposed and configured to receive a mating conductor inserted therein and electrically conductively connected thereto.

3. The shield terminal of claim 2, wherein the air chamber is in an area corresponding to the substantially tubular body in the front-rear direction.

4. The shield terminal of claim 3, further comprising:

at least one locking portion formed on the substantially tubular body; and the at least one retaining portion engages the at least one locking portion for restricting rearward displacement of the inner conductor (15).

5. The shield terminal of claim 4, wherein the air chamber is disposed only in an area of the bottom wall before the retaining portion.

6. The shield terminal of claim 4, wherein the retaining portion is formed on a rear part of the air chamber.

7. The shield terminal of claim 1, wherein:

the first component includes a front wall and wherein the inner conductor is sandwiched between the first component and the second component, the mating conductor being insertable into an insertion opening of the front wall.

8. The shield terminal of claim 7, wherein the first component is made of a material having higher mechanical strength than the second component; and the second component is made of a material having a lower dielectric constant than the first component.

9. The shield terminal of claim 8, wherein the material of the second component is polypropylene (PP), polyethylene (PE), polystyrene (PS) or foamed polybutylene terephthalate.

10. The shield terminal of claim 1, wherein the shield connector is a connecting member forming part of a wiring harness for Ethernet.

11. The shield terminal of claim 7, wherein the first component has plural air chambers extending from the at least one conductor accommodating chamber to the at least one outer conductor, and wherein the second component has a plural air chambers extending from the at least one conductor accommodating chamber to the at least one outer conductor.

12. The shield terminal of claim 7 wherein the at least one conductor accommodating chamber comprises first and second conductor accommodating chambers, and the at least one inner conductor comprises first and second inner conductors disposed respectively in first and second conductor accommodating chambers, the at least one air chamber comprises at least one first air chamber extending between the first conductor accommodating chamber and the outer conductor and at least one second air chamber extending between the second conductor accommodating chamber and the outer conductor.

13. The shield terminal of claim 12, wherein the at least one first air chamber comprises plural first air chambers and wherein the at least one second air chamber comprises plural second air chambers.

14. The shield terminal of claim 13, wherein the plural first air chambers include at least one first air chamber in the first component and at least one first air chamber in the second component, and wherein the plural second air chambers include at least one second air chamber in the first component and at least one second air chamber in the second component.

15. The shield terminal of claim 7, wherein the first component is formed with a locking opening for engaging a locking projection on the second component, the air chambers being spaced from the locking opening.

* * * * *